US006615995B2

(12) United States Patent
Primiano et al.

(10) Patent No.: US 6,615,995 B2
(45) Date of Patent: Sep. 9, 2003

(54) MERCHANDISING DISPLAY TRACK DEVICE

(75) Inventors: Bernard Primiano, Marietta, GA (US); Ming Sun, Roswell, GA (US)

(73) Assignee: Display Industries, LLC., Norcross, GA (US)

( * ) Notice: Subject to any disclaimer, the term of this patent is extended or adjusted under 35 U.S.C. 154(b) by 0 days.

(21) Appl. No.: 09/999,317

(22) Filed: Oct. 31, 2001

(65) Prior Publication Data

US 2003/0080075 A1 May 1, 2003

(51) Int. Cl.[7] ..... A47F 1/04
(52) U.S. Cl. ..... 211/59.2; 211/74; 211/175
(58) Field of Search ..... 211/59.3, 59.2, 211/175, 184, 74, 186, 187, 188; 312/71, 72, 42, 45; D6/408; 238/10 E–10 F; D21/540–541; 104/53

(56) References Cited

U.S. PATENT DOCUMENTS

| | | | | | |
|---|---|---|---|---|---|
| 2,218,444 | A | * | 10/1940 | Vineyard | 211/59.2 |
| 3,562,950 | A | * | 2/1971 | Genin | 104/53 |
| 4,091,995 | A | * | 5/1978 | Barlow et al. | 238/10 A |
| 4,724,968 | A | * | 2/1988 | Wombacher | 211/184 |
| 4,730,741 | A | * | 3/1988 | Jackle et al. | 211/59.3 |
| 4,958,739 | A | * | 9/1990 | Spamer | 211/153 |
| 4,997,094 | A | * | 3/1991 | Spamer et al. | 211/153 |
| 5,024,336 | A | * | 6/1991 | Spamer | 211/153 |
| 5,050,748 | A | * | 9/1991 | Taub | 211/59.2 |
| 5,085,148 | A | * | 2/1992 | Konno | 104/130.09 |
| 5,351,838 | A | * | 10/1994 | Flum | 211/59.2 |
| 5,454,513 | A | * | 10/1995 | Wilson | 238/10 E |
| 5,458,248 | A | * | 10/1995 | Alain | 211/153 |
| 5,503,330 | A | * | 4/1996 | Riley | 238/10 B |
| 5,634,564 | A | | 6/1997 | Spamer et al. | 211/59.3 |
| 5,645,176 | A | | 7/1997 | Jay | 211/59.2 |
| 5,685,664 | A | * | 11/1997 | Parham et al. | 211/59.3 |
| 5,788,091 | A | * | 8/1998 | Robertson et al. | 211/59.2 |
| D401,436 | S | * | 11/1998 | Jay | D6/408 |
| 5,862,923 | A | | 1/1999 | Nordquist et al. | 211/59.2 |
| 6,082,556 | A | * | 7/2000 | Primiano et al. | 211/59.2 |
| 6,155,177 | A | * | 12/2000 | Backfisch | 104/124 |
| 6,325,221 | B2 | * | 12/2001 | Parham | 211/183 |
| 2001/0020606 | A1 | * | 9/2001 | Battaglia et al. | 211/59.2 |

* cited by examiner

*Primary Examiner*—Daniel P. Stodola
*Assistant Examiner*—Jennifer E. Novosad
(74) *Attorney, Agent, or Firm*—John L. James

(57) ABSTRACT

An elongate display track device has one or more intermediate sections, a front section with a front piece and product identification panels, and a rear section with a stop member. The sections are frangibly connected to alter the length of the track device. The sections are releasably connected by keys and keyways. The length is changed by removing one or more intermediate sections, then re-attaching the rear section to provide the stop member. The front piece provides a surface along its bottom for a product identification label. Arms upstanding from the front track section support a panel which provides a surface for product identification.

12 Claims, 4 Drawing Sheets

MERCHANDISING DISPLAY TRACK DEVICE

TECHNICAL FIELD OF THE INVENTION

This invention relates to a track device for a merchandising display shelf, and, more particularly, to an adjustable length track device for articles on the shelf, particularly bottles, to slide along.

BACKGROUND OF THE INVENTION

A display rack unit is assembled from multiple track devices for merchandising articles such as bottled on canned drink products. The display rack unit includes a plurality of elongated track devices detachably interconnected in side-by-side relationship. The number of track devices used to assemble the display rack unit is determined such that the size of the unit is suitable for placement onto an existing display shelf in a retail environment to fill the width of the shelf.

Display racks are useful for displaying bottles, especially beverage bottles, because a rack stacks many bottles using a limited amount of shelf space which is always at a premium. Racks foster a neat display and allow one bottle at a time to be removed without disheveling the other bottles. It is always desirable to have a rack that maximizes product while minimizing shelf space required, reduces manufacturing cost, or reduces transportation and storage costs. It has been found that manufacturing costs are reduced when a single size track device is produced that has a frangible rear portion that can be removed during installation to fit the front to rear length of a particular shelf. Removing the rear section shortens the length of the track device to fit a particular shelf.

A problem with track devices with removable rear sections is that the rear section typically has a stop member that is removed when the rear section is removed. The function of the stop member is to prevent articles from falling out the rear of the track device when articles in the row of articles in the track device are pushed from the front while removing the lead article for purchase. Thus, when the rear section, and therefore the stop member, is removed, articles can be pushed out the rear which is undesirable.

Another problem with track devices with removable rear sections is that once the rear is removed, it is permanently detached from the front portions of the track device. Although permanently detached, the rear section can be used again by placing it on the shelf adjacent the front portions of the track device. While such use works effectively to reduce friction for the articles sliding thereon compared to sliding on the bare shelf, the rear portion is not an effective stop member. Accordingly, it will be appreciated that it would be highly desirable to have a track device whose length can be varied to fit a particular shelf but that always has a rear stop member.

Track devices also require a stop member on the front which is referred to as a front piece. An ideal front piece stops the forward motion of the articles to prevent inadvertent removal while allowing intentional removal by a purchaser, and provides a window for easily viewing the product label. An unfortunate problem with beverage bottles in track devices is that the product labels do not always face forward thereby obscuring product identification. It will be appreciated that it would be highly desirable to have an adjustable track device with a front piece that improves product identification.

SUMMARY OF THE INVENTION

The present invention is directed to overcoming one or more of the problems set forth above. Briefly summarized, according to one aspect of the invention, an elongate display track device for receiving a row of articles for sliding movement therealong, comprises front, rear and intermediate track segments. The front track segment has a base wall, opposite side edges and at least one sidewall upstanding from one of the side edges. The base wall of the front track segment has a front end portion and a rear end portion defining a keyway. The rear track segment has a base wall, opposite side edges and at least one sidewall upstanding from one of the side edges. The base wall of the rear track segment has a front end portion defining a key and a rear end portion. The intermediate track segments are positioned between the front and rear track segments. Each intermediate track segment has a base wall, opposite side edges and at least one sidewall upstanding from one of the side edges. Each base wall of an intermediate track segment has a front end portion defining a key and a rear end portion defining a keyway. The key of an intermediate track segment releasably interlocks with the keyway of the front track segment or the keyway of another intermediate track segment, and the keyway of an intermediate track segment releasably interlocks with the key of the rear track segment or another intermediate track segment.

Removing the intermediate track segments changes the length of the track device allowing the track device to conform to the length of the cooler shelf. Other track segments called extensions can be added to increase the length of the track device to accommodate longer shelves. Extensions differ from intermediate track segments in the size of the keys and keyways. Intermediate track segments that interlock against longitudinal displacement while extensions have keys and keyways that interlock to prevent both longitudinal and vertical displacement.

A rear panel upstanding form the base wall of the rear track segment inhibits rearward movement of articles on the rear track segment to prevent the articles from falling out the rear of the track device. By removing intermediate track segments and retaining the rear track segment, articles are prevented from falling off the back of the display shelf.

Each key and each keyway has a circular configuration of more than half a circle so that the key and keyway interlock to prevent longitudinal separation of the track segments. The key of the rear segment is larger than the keys of the intermediate segments so that the rear segment locks into a keyway to prevent both longitudinal and vertical displacement. The circular configuration is easy to manufacture because manufacturing tolerances are not as critical for circles as with other configurations and is stronger.

A front piece connecting to the front track segment provides a lower panel for attaching a product identification label. A pair of upwardly extending arms support an upper panel for attaching a product identification label. The lower panel lies below articles on the track, and the upper panel lies above articles on the track and behind the lead article. The panels can accept decals or labels to identify product on the track making product orientation less critical.

These and other aspects, objects, features and advantages of the present invention will be more clearly understood and appreciated from a review of the following detailed description of the preferred embodiments and appended claims, and by reference to the accompanying drawings

DETAILED DESCRIPTION OF THE PREFERRED EMBODIMENTS

Referring to FIGS. 1–5, a display rack unit assembled from multiple track devices is designed to merchandise articles such as bottled or canned drink products. The display rack unit includes a plurality of elongated track devices 10 detachably interconnected in side-by-side relationship. The number of track devices used to assemble the display rack unit is determined such that the size of the unit is suitable for placement onto an existing display shelf in a retail environment. The interconnection of two adjacent track devices is achieved by connecting means such as connector slots 12 cooperating with L-shaped horizontal connector elements 14. Details of the track devices and connector elements are more fully described in U.S. Pat. No. 5,634,564, which issued Jun. 3, 1997 to Spamer et al., the disclosure of which is incorporated herein by reference.

Figure 1:
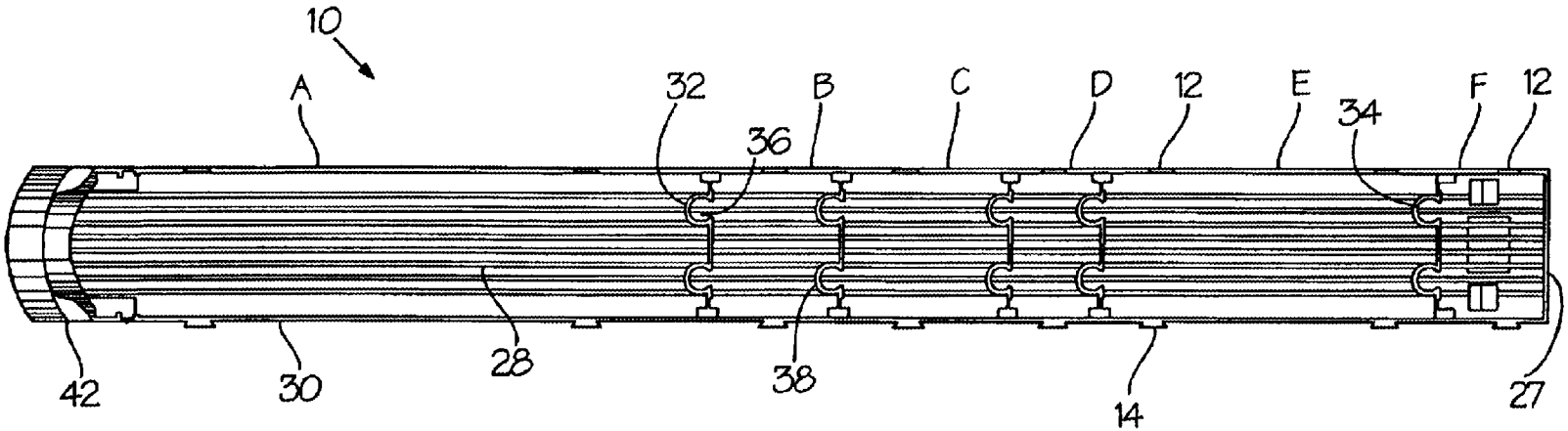
FIG. 1 is a top view of a preferred embodiment of an adjustable track device according to the present invention.
Figure 2:
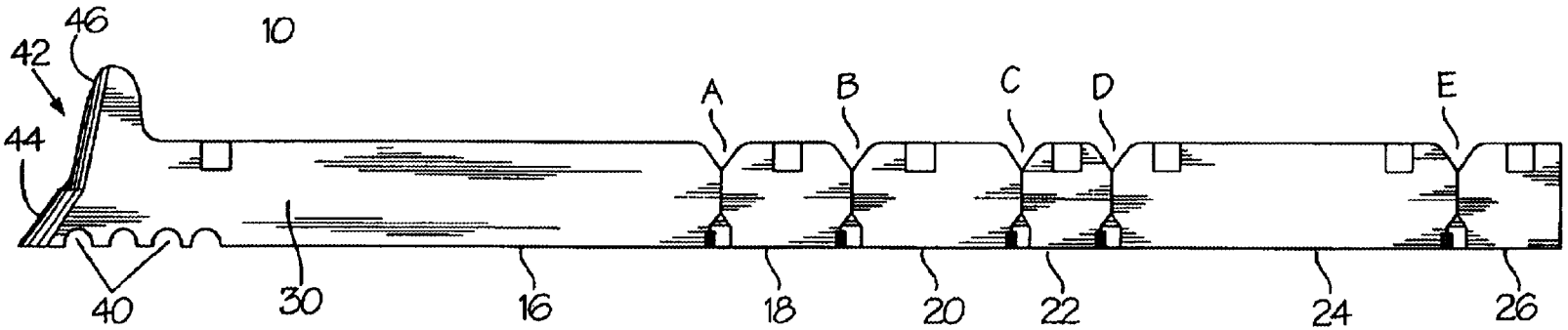
FIG. 2 is a side view of the adjustable length track device of FIG. 1.

Referring to FIGS. 1–2, an elongated display track device 10 receives a row of articles for sliding movement therealong. Display track device 10 is composed of a number of sections or segments that are frangibly connected end-to-end to one another. A frangible connection may be made by connecting two members of normal thickness with a section of the same, but much thinner, material. There is a front segment 16 that is connected to a first intermediate segment 18 along fracture line A. First intermediate segment 18 is connected to a second intermediate segment 20 along fracture line B which is connected to a third intermediate segment 22 along fracture line C. Third intermediate segment 22 is connected along fracture line D to a fourth intermediate segment 24. A rear segment 26 is connected to intermediate section 24 along fracture line E. Any one or all of intermediate segments 18, 20, 22, 24 may be removed with rear segment 26 then connecting to either the front segment 16 or to any intermediate segment remaining that is nearest the rear segment 26.

The front track segment 16 has a floor or base wall 28, opposite side edges and at least one sidewall 30 upstanding from one of the side edges. Where there is a single track device, it will be equipped with the one upstanding sidewall that is integrally formed with the base wall and may have a removably attached sidewall for a total of two sidewalls to form a channel for a single row of articles to slide therebetween. Where there are multiple track devices in side-by-side relationship, adjacent track devices may share a common sidewall which is the integrally formed sidewall, except for the leftmost or rightmost track device which may have a removably attached sidewall. Alternatively, where there is but a single track device, it may have both sidewalls integrally formed. Of course, each track device can have two integrally formed sidewalls when sidewall thickness is taken into account for shelves of standard width so that a predetermined number of track devices will fit onto the shelf.

Base wall 28 has a front end portion that will be disposed at the front of the display shelf and a rear end portion that defines a keyway 32. The keyway 32 of the base wall 28 of the front track segment 16 has a circular configuration. Preferably, the circular configuration is more than half a circle that extends from a rear edge of the rear end portion of the base wall 28 of the front track segment 16 inward toward the front end portion of the front track segment 16. The keyway 32 is similar to the keyway surrounding the top of the key of a basketball court.

The rear track segment 26 also has a base wall, opposite side edges and at least one sidewall upstanding from one of the side edges. The base wall has a front end portion defining a key 34 and a rear end portion. The key 34 of the rear track segment 26 has a circular configuration of more than half a circle protruding from a front edge of the base wall of the rear track segment. Both the key 34 and keyway 32 have a circular configuration of more than half a circle so that when the key is placed in the keyway they interlock to prevent longitudinal separation and removal. If they are half a circle or less, there is no interlocking action and they can be easily pulled apart in the longitudinal direction. When used on a shelf, some forces acting to separate the track segments are in the longitudinal direction which is from front to rear or rear to front of the shelf. All of the keys and keyways prevent longitudinal separation.

A rear panel 27 is upstanding from the base wall of the rear track segment 26 and stretches across the rear of the track device to inhibit rearward movement of articles in the rear track segment. The rear panel 27 is a stop member that stops articles from falling out the rear of the track device. Because of the stop member, it is always desirable, but not necessary, to use the rear segment 26 and remove one of the intermediate sections 18, 20, 22, 24 to vary the length of the track device. Rear panel 27 is preferably integrally formed with the base wall or upstanding sidewall of the rear segment but may be detachably connected thereto.

Intermediate track segment 18 also has a base wall, opposite side edges and at least one sidewall upstanding from one of the side edges. The base wall has a front end portion defining a key 36 and rear end portion defining a keyway 38. Key 36 has a circular configuration of more than half a circle protruding from a front edge of the base wall of intermediate track segment 18. Keyway 38 has a circular configuration of more than half a circle extending from a rear edge of a rear end portion of intermediate track segment 18 that extends inward toward the front end portion of intermediate track segment 18. The key 36 of intermediate track segment 18 releasably interlocks with the keyway 32 of the front track segment 16 while the keyway 38 of intermediate track segment 18 releasably interlocks a key of another intermediate segment or with key 34 of the rear track segment.

When the rear panel 27 is detachably connected, it is preferred that it have a base wall with a key or keys. The key of the rear panel 27 or rear track segment is larger than other keys so as to provide a tight fit that also prevents vertical separation. If vertical separation occurs, bottles or other items attempting to slide along the track encounter difficulty or stop sliding altogether. Vertical separation may be further inhibited by tapering the inside perimeter of a key and outside perimeter of a keyway so that the key snaps into the keyway.

The sidewall panel 30 of the font track segment 16 defines one or more recesses 40 along its bottom edge. These recesses 40 are adapted to engage and rest on a wire of a wire shelf to inhibit movement of the track device relative to the wire shelf. When used on a shelf, the shelf may be flat or horizontal, or it may be inclined so that the rear of the shelf is at a higher elevation than the front of the shelf to help articles slide forward to the front of the shelf. In either case, the recesses will engage either one of the wire mesh members or a ledge, lip or ridge running along the front of the shelf to prevent movement of the track device. Where the shelf is inclined, the recesses are critical because gravity will cause the track device to slide forward on the shelf, or possibly off the shelf completely. There are preferably several recesses 40 to project different lengths of the track device forward to fill space between the front of the shelf and the door of the cooler.

There are common or popular sizes for coolers with wire shelving. Popular sizes may include front dimensions of 15, 17.5, 20.5, 22.125, and 28.5 inches. These lengths are accommodated with the adjustable track device by having an overall length for front segment 16 of 12.75 inches, and lengths for segments 18, 20, 22, 24 and 26 of 2.5, 3.0, 1.625, 5.125 and 2.0 inches, respectively. Fracture lines A, B, C, D and E are positioned to accommodate the popular cooler sizes. A 10-inch intermediate extension piece can be used to extend the track. For example, detaching rear segment 26 at fracture line E and inserting one 10-inch extension piece achieves a 36 inch long track, or two 10-inch extension pieces can be used to obtain a 46 inch long track. It has been discovered that, when extension pieces are used and the track device is 36 inches or more long, rear track segment 26 need not be used because there is virtually no danger of articles pushed from the front of the track device being forced out the rear.

The key of each extension piece are the same dimensions as the key of the rear segment to prevent vertical displacement. Likewise, the keyways of each intermediate section and each extension are the same dimensions as the keyway of the front track segment. All keyways have the same dimensions, but the keys have different dimensions with the rear track segment and extensions having the largest dimensions to prevent vertical separation. The intermediate track segments are frangibly connected during manufacture and not dependent on interlocking keys and keyways to prevent vertical separation.

Still referring to FIGS. 1–2, the track device 10 has a front piece 42 that is attached to the front track segment 16 which acts as a front stop for articles in the track. As articles are placed in the track from the rear they slide forward and come to rest against front piece 42. Front piece 42 has a panel 44 that extends along a bottom edge portion thereof. A top edge of panel 44 is positioned at the same elevation or lower elevation than the elevation of the bottom wall 28 of the front track segment 16. Preferably, the top edge of panel 44 is at the same elevation as the top surface of bottom wall 28 so that articles slide smoothly from the base wall 28 of the front track segment 16 to the front piece 42. Front piece 42 will have side panels that project into the path of the articles to prevent the articles sliding out the front of the track.

Panel 44 is preferably slanted with the top edge of the panel tilted inward toward the front track segment 16, and with a bottom edge of panel 44 tilted away from front track segment 16. As viewed in FIG. 2, panel 44 makes an acute angle with a bottom edge of the sidewall 30 of the front segment 16. Front panel 44 slants backward while side panels 46 also slant backward but not as much as panel 44. A line projecting from panel 46 makes a greater angle with the bottom edge of the sidewall than the acute angle formed by bottom panel 44 and the bottom edge of the sidewall. This gives panel 46 more of a vertical slant, and, when the shelf is slanted, panel 46 may be exactly vertical when used on the shelf, which is advantageous because it will keep the product label plumb. Panel 44 is preferably curved with a middle portion of the panel extending away from front track segment 16 more than either side edge of the panel giving panel 44 a curved or rounded appearance when viewed from the front. Panel 44 actually has a convexoconcave configuration.

Figure 3:
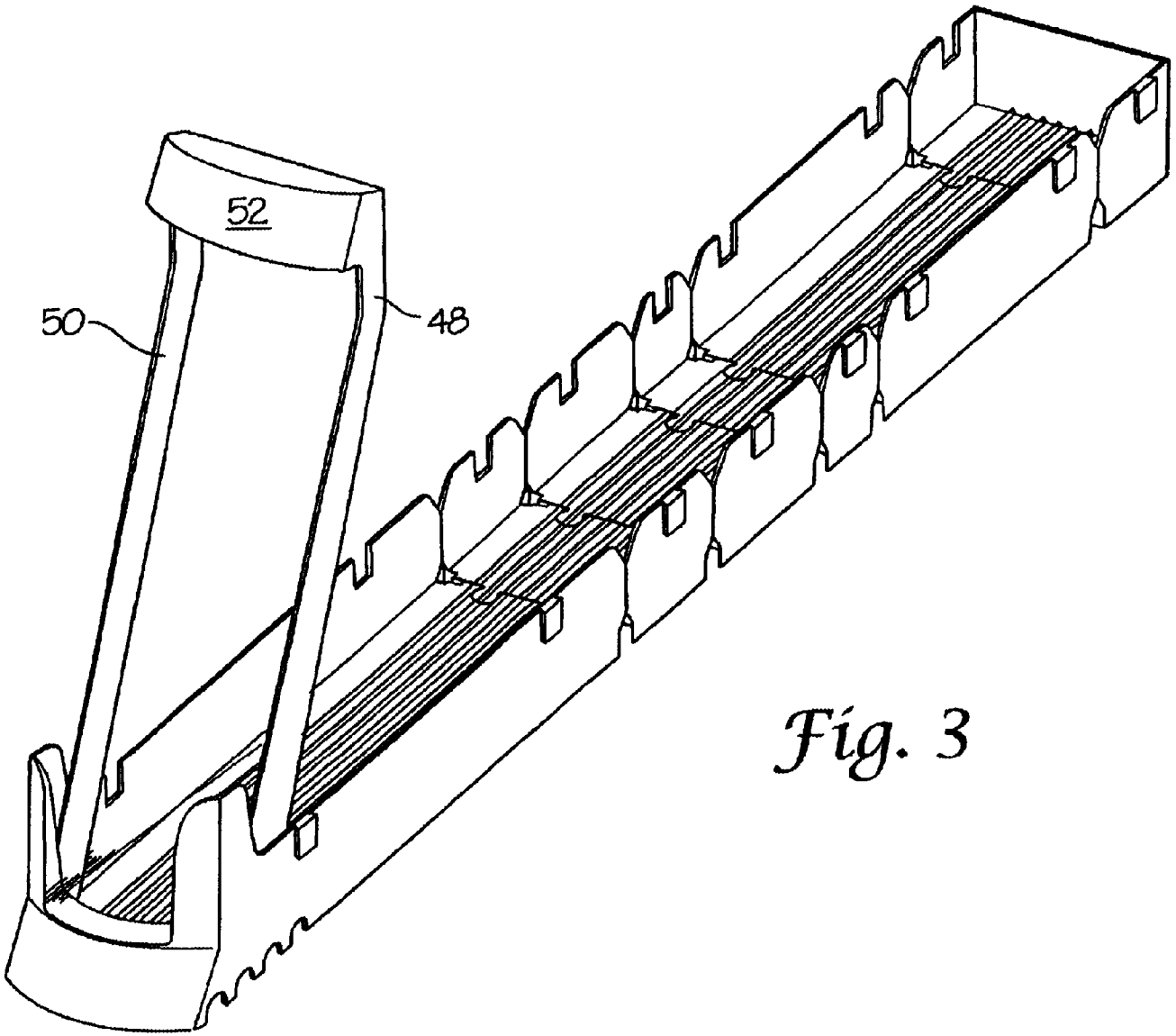
FIG. 3 is a perspective view of another embodiment of an adjustable length track device incorporating a front piece and label holder.

Referring now to FIG. 3, the track device has first and second upwardly extending arms 48, 50 that are preferably detachably connected to the front track segment of the track device. Detachable arms facilitate compactness for shipping the units. The arms slant backward forming an acute angle with the sidewall similar to the angle that the bottom panel of the front piece makes with the sidewall. A panel 52 is attached to a top portion of the arms 48, 50. Panel 52 is curved similar to the front piece panel with side edges of panel 52 extending rearward toward the rear track segment more than a middle portion of the panel 52. The panels provide areas for placing decals or other product identification. The arms are angled such and have a length such that the panel 52 does not interfere with articles placed o the track device, and, preferably, is positioned behind the first article at the front of the display track that is to be removed (see FIG. 5)

Figure 4:
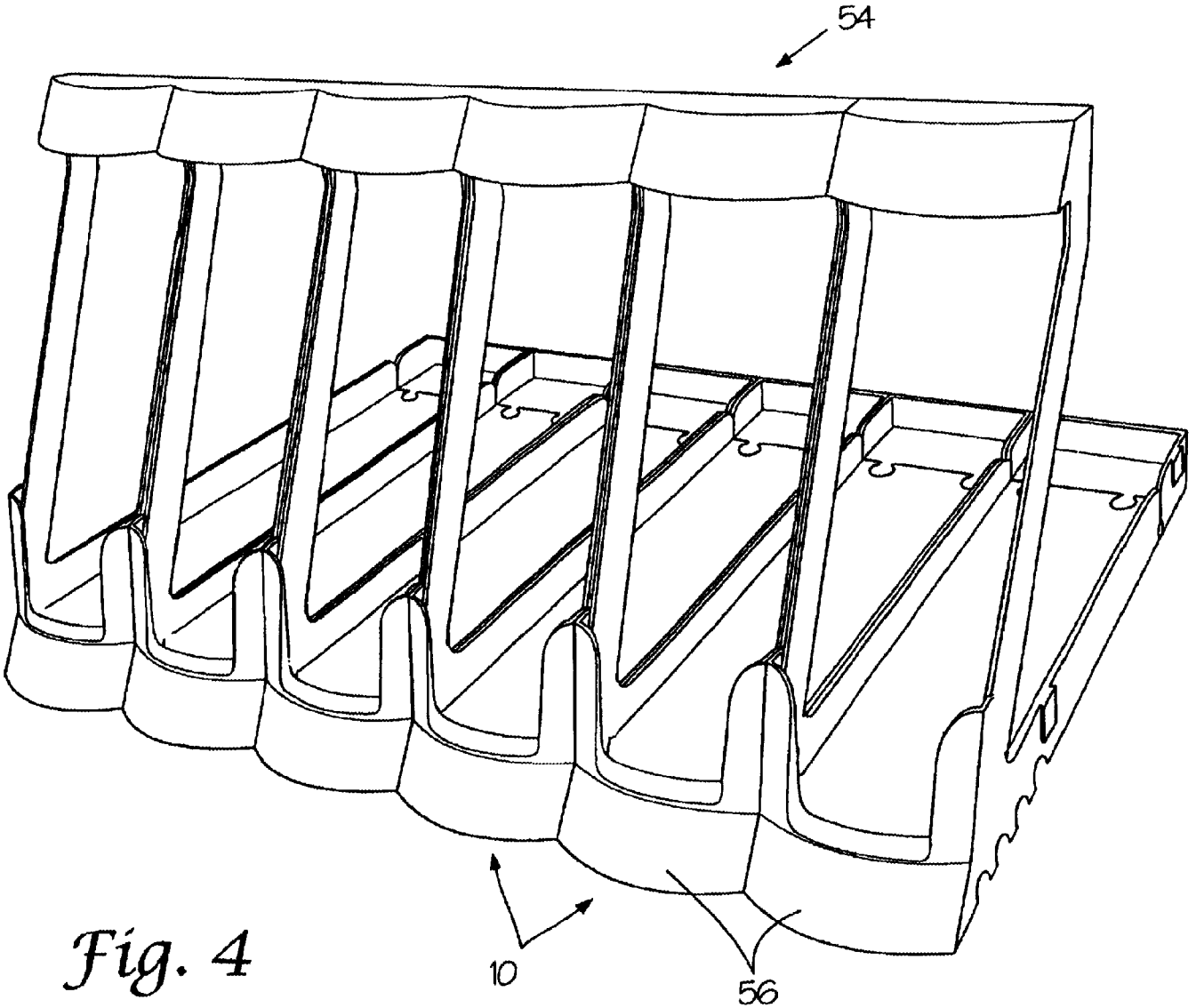
FIG. 4 is a perspective view similar to FIG. 3 but illustrating another embodiment with multiple display track attached side-by-side to one another.
Figure 5:
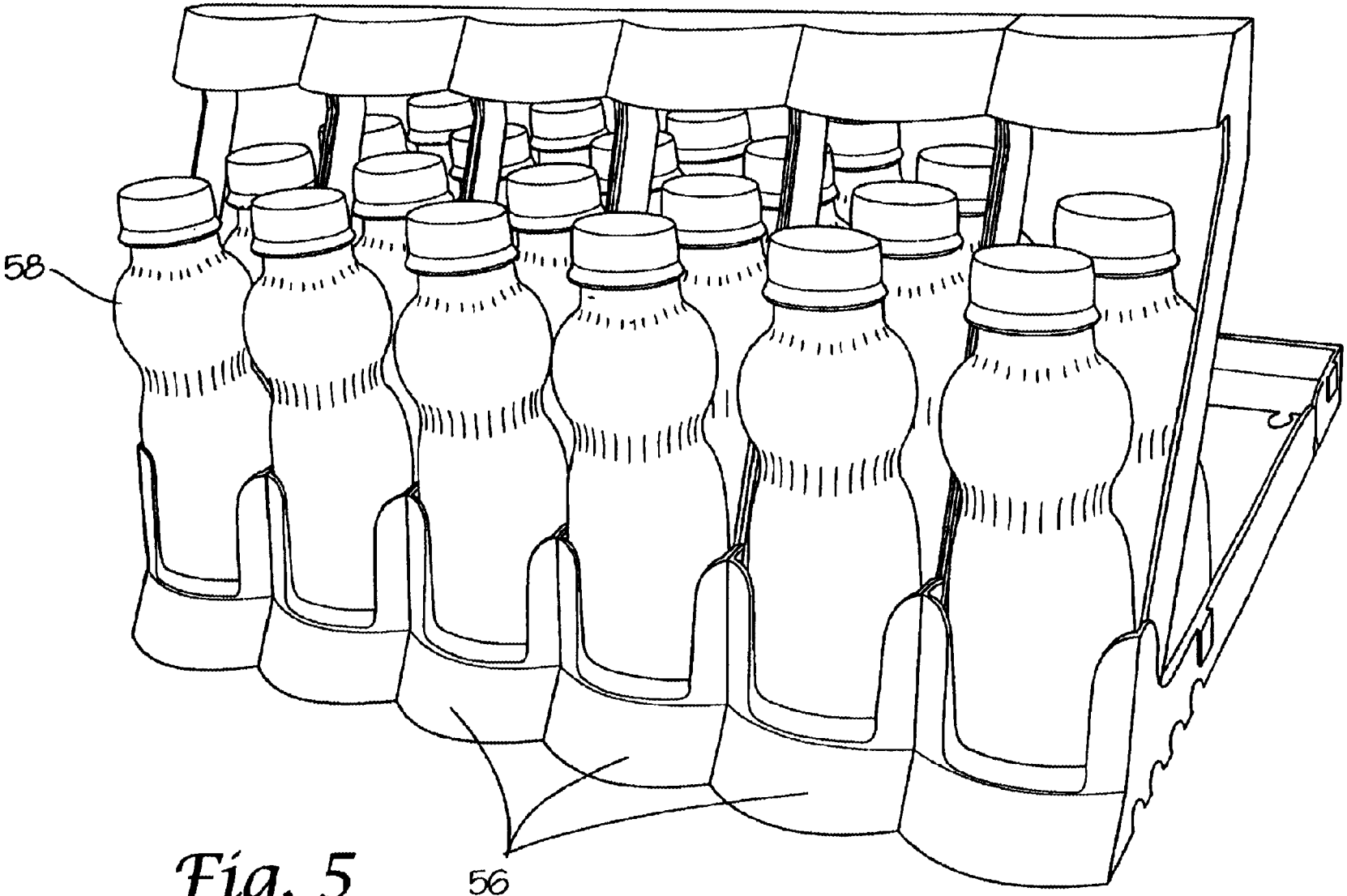
FIG. 5 is a perspective view similar to FIG. 4 but illustrating the track device with bottles inserted.

Referring to FIGS. 4–5, a display shelf unit 54 is constructed of several, in this instance six, track devices 56 connected to one another in side-by-side relationship. As can be seen, the top panels supported on the arms are above and behind the lead bottles 58 while the front piece panels are below but forward of the bottles. Placing product identification labels or decals on the upper and lower panels makes product label orientation les critical.

It can now be appreciated that a track device for a merchandising display shelf for a plurality of bottles to slide along has been presented. The track device is formed of track segments connected together in end-to-end relationship to fill the length of the shelf with tracks connected together in side-by-side relationship to fill the width of the shelf. The track segments include a front segment with one or more, preferably two, keyways, and a rear segment with an equal number of keys. A number of intermediate track segments have both keys and keyways. As intermediate track segments are removed to fit a particular shelf, the keys and keyways at the break interlock to prevent separation of the track segments. A rear stop member connected to the rear track segment prevents backward egress of the articles while a front piece connected to the front track segment prevents inadvertent forward egress of the articles on the track. Recesses on the front segment fix the track device to the shelf preventing relative movement between the track device and shelf. A panel on the front piece provides an area for product identification on a lower portion of the track device while a panel supported on arms provides an area for product identification on an upper portion of the track device.

While the invention has been described with particular reference to the preferred embodiments, it will be understood by those skilled in the art that various changes may be made and equivalents may be substituted for elements of the preferred embodiments without departing from invention. For example, while the key and keyway have been described as circular, other shapes can be used with equal success to prevent longitudinal separation of the track segments, And while the upper product identification panel is suspended on slanted arms, the arms could be straight with the panel slanted or tilted. It is accordingly intended that the claims shall cover all such modifications and applications as do not depart from the true spirit and scope of the invention.

What is claimed is:

1. An elongate, gravity feed, merchandising display track device for receiving a row of articles for sliding movement therealong for dispensing one article at a time, comprising:

a front track segment having a base wall, opposite side edges and at least one sidewall upstanding from one of said side edges, said base wall having a front end portion and a rear end portion defining a keyway, said sidewall defining at least one recess adapted to engage and rest on a wire of a wire shelf to inhibit movement of said track device;

a front piece having a panel along a bottom portion thereof and being attached to said front track segment, said panel having a top edge positioned at an elevation not higher than said base wall of said front track segment;

a rear track segment having a base wall, opposite side edges and at least one sidewall upstanding from one of said side edges, said base wall having a front end portion defining a key and a rear end portion;

a rear panel upstanding from said base wall of said rear track segment adapted to inhibit rearward movement of articles in said rear track segment; and an intermediate track segment positioned between said front and rear track segments, said intermediate track segment having a base wall, opposite side edges and at least one sidewall upstanding from one of said side edges, said base wall having a front end portion defining a key and a rear end portion defining a keyway, said key of said intermediate track segment releasably interlocking with said keyway of said front track segment, said keyway of said intermediate track segment releasably interlocking with said key of said rear track segment.

2. An elongate display track device, as set forth in claim 1, wherein said keyway of said base wall of said front track segment has a circular configuration of more than half a circle extending from a rear edge of said rear end portion of said base wall of said front track segment inward toward said front end portion of said front track segment.

3. An elongate display track device, as set forth in claim 1, wherein said key of said rear track segment has a circular configuration of more than half a circle protruding from a front edge of said base wall of said rear track segment.

4. An elongate display track device, as set forth in claim 1, wherein said keyway of said base wall of said intermediate track segment has a circular configuration of more than half a circle extending from a rear edge of said rear end portion of said base wall of said intermediate track segment inward toward said front end portion of said intermediate track segment, and wherein said key of said intermediate track segment has a circular configuration of more than half a circle protruding from a front edge of said base wall of intermediate track segment.

5. An elongate display track device, as set forth in claim 1, wherein said panel is slanted with said top edge of said panel tilted toward said front track segment and with a bottom edge of said panel tilted away from said front track segment.

6. An elongate display track device, as set forth in claim 1, wherein said panel is curved with a middle portion of said panel extending away from said front track segment more than either side edge of said panel.

7. An elongate display track device, as set forth in claim 1, including:

first and second upwardly extending arms detachably attached to said front track segment; and a panel attached to a top portion of said arms.

8. An elongate display track device, as set forth in claim 7, wherein said panel is curved with side edges of said panel extending rearward toward said rear track segment more than a middle portion of said panel.

9. An elongate display track device, comprising:

a front track segment having a base wall, opposite side edges and at least one sidewall upstanding from one of said side edges, said base wall having a front end portion and a rear end portion defining a keyway;

a rear track segment having a base wall, opposite side edges and at least one sidewall upstanding from one of said side edges, said base wall having a front end portion defining a key and a rear end portion;

first and second upwardly extending arms detachably attached to said front track segment;

an upper panel attached to a top portion of said arms;

a front piece attached to said front track segment, said front piece having a lower panel along a bottom portion thereof, a top edge of said lower panel being positioned at an elevation not higher than said base wall of said front track segment.

10. An elongate display track device, as set forth in claim 9, wherein said panel is curved with side edges of said upper panel extending rearward toward said rear track segment more than a middle portion of said upper panel.

11. An elongate display track device, as set forth in claim 9, wherein said sidewall of said front track segment defines at least one recess adapted to engage and rest on a wire of a wire shelf to inhibit movement of said track device.

12. An elongate display track device, as set forth in claim 9, wherein said lower panel is curved with a middle portion of said lower panel extending away from said front track segment more than either side edge of said lower panel.

* * * * *